US005749462A

United States Patent [19]

Houghton

[11] Patent Number: 5,749,462

[45] Date of Patent: May 12, 1998

[54] IMPROVEMENTS IN FLIP-TOP TYPE CARTON CONTAINERS

[75] Inventor: Kenneth Arthur Houghton, Hull, England

[73] Assignee: Reckitt & Colman Products Limited, London, United Kingdom

[21] Appl. No.: 654,757

[22] Filed: May 30, 1996

[30] Foreign Application Priority Data

Jun. 2, 1995 [GB] United Kingdom ..... 9511216

[51] Int. Cl.[6] ..... B65D 85/10; B65D 43/16

[52] U.S. Cl. ..... 206/268; 206/273; 229/149; 229/160.1

[58] Field of Search ..... 206/268, 273; 229/160.1, 149, 225

[56] References Cited

U.S. PATENT DOCUMENTS

| | | | |
|---|---|---|---|
| 2,011,438 | 8/1935 | Daller . | |
| 2,361,597 | 10/1944 | Buttery | 229/149 X |
| 2,361,659 | 10/1944 | Smith | 229/160.1 X |
| 2,865,498 | 12/1958 | Ringler | 206/273 X |
| 3,039,671 | 6/1962 | Chiamardas . | |
| 3,078,030 | 2/1963 | Gorton . | |
| 3,910,487 | 10/1975 | Jaeschke . | |
| 5,036,982 | 8/1991 | Aston | 229/160.1 X |
| 5,511,722 | 4/1996 | Dixon . | |

FOREIGN PATENT DOCUMENTS

| | | | |
|---|---|---|---|
| 2846467 A1 | 8/1980 | Germany . | |
| 469274 | 7/1937 | United Kingdom | 206/273 |
| 508312 | 11/1938 | United Kingdom . | |
| 587336 | 1/1946 | United Kingdom . | |

*Primary Examiner*—Bryon P. Gehman
*Attorney, Agent, or Firm*—Fish & Richardson P.C.

[57] ABSTRACT

A flip-top type carton container having a top held in a closed position by deflecting, such as by pushing inwardly, a part of the front panel of the top behind a liner panel, which is located internally of an external front panel of a body part. The deflection is usually accomplished by pushing inwardly on the lower regions of the top part when the top part is lowered into a closed position, and the lower regions of the top part may comprise one or more lugs, which may be of arcuate shape. The container thereby provides more convenient and more positive closure than previously available.

4 Claims, 2 Drawing Sheets

IMPROVEMENTS IN FLIP-TOP TYPE CARTON CONTAINERS

Figure 1:
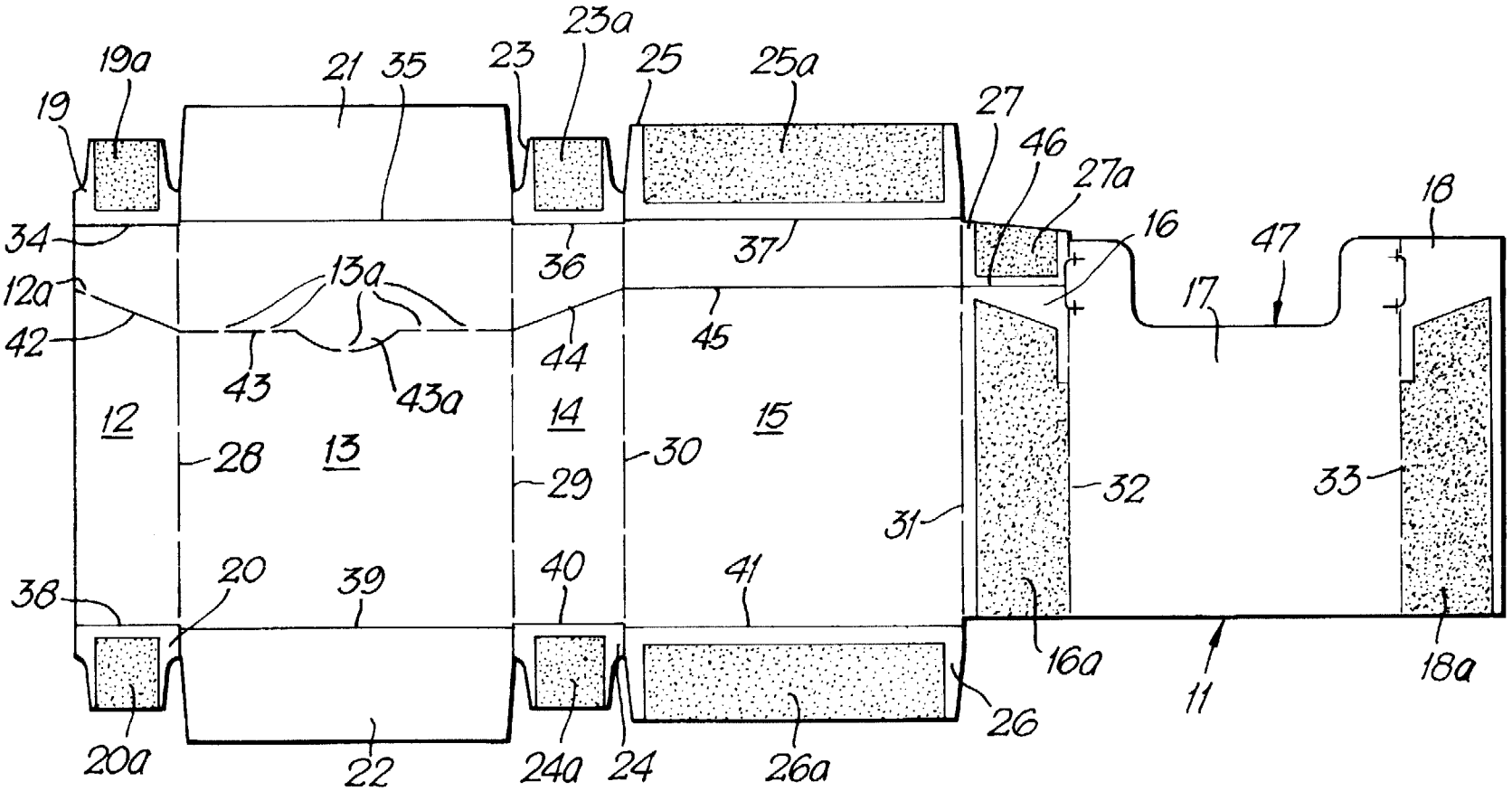

This invention relates to containers and, more specifically, to so-called "flip-top" containers.

Flip top containers are well known in the art and generally comprise a body part and a top part hingedly connected to the body part. The body part is defined by a front panel, two side wall panels, a rear panel, two inner side wall panels, an inner front panel and a bottom panel. The top part is defined by a front panel, two outer side wall panels, at least one inner side wall panel, a rear panel and a top panel.

In this specification the terms "top" and "bottom" refer to the flip-top container when said container is standing on the bottom panel of the body part with the top part uppermost and the terms "front" and "rear" relate to a container when the container is upright and the hinge of the top part with the body part is rearmost.

As stated, the body part is connected to the top part by a hinge, which extends along the top edge of the rear panel of the body part and along the bottom edge of the rear panel of the top part. Said hinge allows the top part to rotate about the axis of the hinge between an open condition of the container, and in which condition the contents of the container are exposed for access, and a closure condition of the container in which the contents are fully contained within the container.

Most flip-top containers are made from a blank, of relatively stiff paper or card, and the blank is folded along predetermined lines with overlapping parts of the blank glued together to the required configuration. In such a case the hinge may be formed by a weakened line, perforated or scored, and in practice the top part can be hingedly displaced between its open and closed conditions a number of times before the hinge fails.

A problem with flip-top containers resides in the fact that once the container is breached there is a difficulty in closing the container to fully protect the contents thereof. In practice the body part may include a front panel liner, inward of the front panel of the body part, and which extends into the top part to assist in retaining the top part in its closure position. However, in practice, that part of the liner which protrudes into the top part is readily deformed and the frictional forces which hold the liner and the top part in contacting relationship are reduced, so that accidental opening of the lid is facilitated.

The present invention seeks to provide a flip-top type container wherein the top can be more positively held in a closure condition than flip-top containers known to date.

According to the present invention there is provided a flip-top container comprising a body part and a top part hingedly connected to the body part and wherein there is provided a liner panel, internally of and generally in contact with the external front panel of the body part, characterised in that said liner panel extends upwardly of the external front panel of the body part and, when the container has been breached, part of the lower regions of the front panel of the top part can be deflected to engage behind the upward protrusion of the liner panel.

According to another aspect of the invention there is provided a flip-top container comprising a body part and a top part hingedly connected to the body part and wherein there is provided a liner panel, internally of and generally in contact with the external front panel of the top part, characterised in that said liner panel extends downwardly from the external front panel of the top part and, when the container has been breached, part of the upper regions of the front panel of the body part can be deflected to engage behind the downward protrusion of the liner panel.

Preferably that part of the front panel to be deflected to engage behind the protruding liner panel comprises a lug.

Preferably the lug has a width which is smaller than the width of the container.

In one embodiment the part presenting the lug presents a plurality of lugs in side by side relationship and all said lugs are engageable behind the liner panel.

In another embodiment the lug engageable with the liner panel has an arcuate configuration.

In a preferred embodiment said top part is attached to the bottom part by spaced apart unperforated container material and said unperforated material is spaced from the junction of the lug with the edge of the panel supporting said lug.

Figure 2:
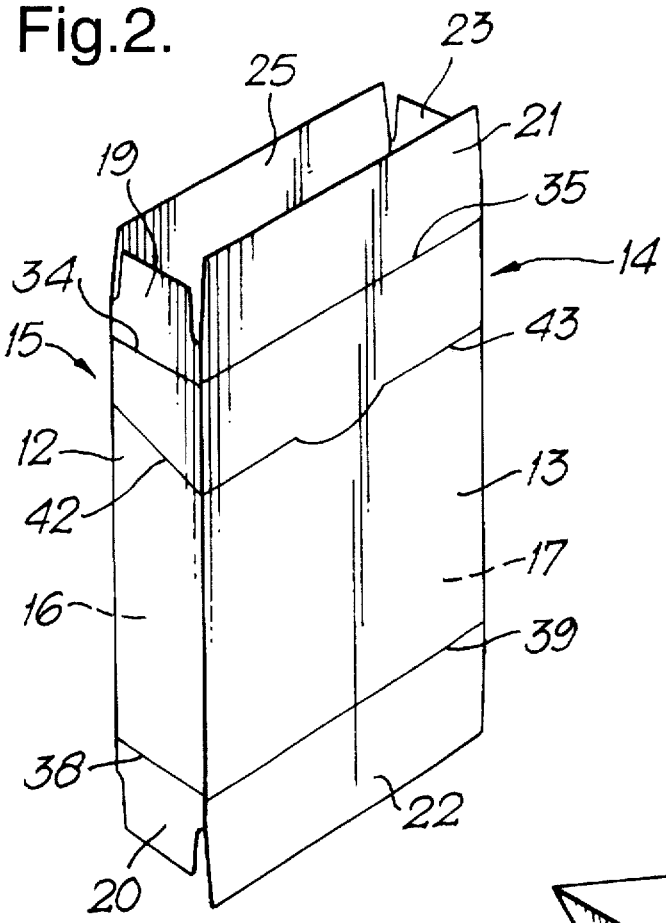
Figure 3:
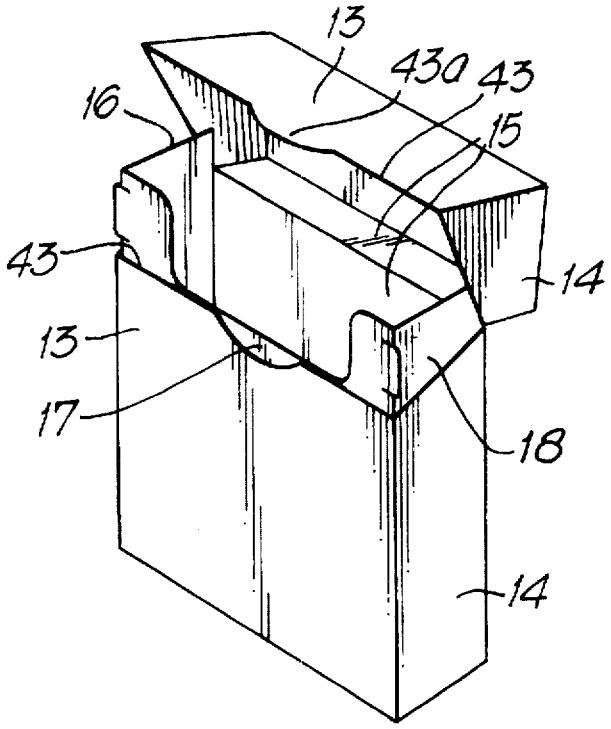

The invention will now be described further to way of example with reference to the accompany drawings in which:

FIG. 1 shows a front view of a blank for a flip top container in accordance with the invention FIG. 2 shows, in perspective view, a partially formed flip-top container and FIG. 3 shows a flip-top container fully formed and in open condition.

In the embodiment illustrated in FIG. 1 a blank 11 for a flip-top container generally comprises an external side wall panel 12, an external front panel 13, an external side wall panel 14, an external rear panel 15, an inner side wall panel 16, an inner front panel 17, and an inner side wall panel 18. The external side wall panel 12 includes upper inner fixing panel 19 and a lower inner fixing panel 20, the external front panel 13 includes an external top panel 21 and a bottom external panel 22, the side wall panel 14 includes an inner top closure panel 23 and a bottom inner closure panel 24, the rear panel 15 includes an inner top closure panel 25 and an inner bottom closure panel 26 which is attached to the lower regions of rear wall panel 15.

The blank 11 includes a crease line 28 between the side wall panel 12 and the front panel 13, a crease line 29 between the panels 13 and 14, a crease line 30 between the panels 14 and 15, a crease line 31 between the panels 15 and 16, a crease line 32 between the panels 16 and 17 and a crease line 33 between the panels 17 and 18.

The panels 12, 13, 14, 15, 16, 17 and 18 lie in side by side relationship and, when the blank is folded along the crease lines 28, 29, 30, 31, 32 and 33, with each fold making a substantially right angle fold along said crease lines 28 to 33 inclusive, the blank 11 has a rectangular tube-like form with side wall panel 12 overlaying the internal panel 16, the panel 17 extending between crease lines 28 and 29 inwardly of and immediately adjacent the front panel 13, and the inner side wall panel 18 lying immediately adjacent, and forming an inner panel in contact with, the external side wall panel 14.

The panel 27 has an area of adhesive **27*a* applied thereto, the panel 16 has an area of adhesive 16*a* applied thereto and the panel 18 has an area 18*a* of adhesive applied thereto. When the adhesive areas 16*a*, 27*a* and 18*a* are activated, and the blank 11 has been folded to form a rectangular tube, the adhesive on areas 16*a*, 27*a* and 18*a* retain their respective panels 16 and 18 in contact with side wall panels 12 and 14, as shown in FIG. 2**.

When now the top part is to be formed the panel 19 is folded along the crease line 34 between panels 12 and 19, a fold is made along the crease line 36 between panels 14 and 23, a fold is made along the crease line 37 between the panels 15 and 25 and a fold is made along the crease line 35 between the panels 13 and 21. The panels 19 and 23 lie lowermost of the panels forming the top of the top part and present upwardly exposed adhesive areas 19*a* and 23*a*, respectively. When areas 19*a* and 23*a* are activated they secure the panels 19 and 23 to the panel 25 and the external panel 21 overlies and is attached to the panel 25 by activation of an area of adhesive 25*a*, on panel 25.

The bottom of the container is formed by folding the blank along the fold line 38 between panels 12 and 20, along the fold line 40 between panels 14 and 24, along the fold line 41 between the panels 15 and 26 and along the fold line 39, between the panels 13 and 22. Area of adhesive 20*a*, applied to panel 20, area of adhesive 24*a*, applied to panel 24, and area of adhesive 26*a*, applied to panel 26 are activated so that the panels 20 and 24 engage and are secured to the inner surface of panel 26 and panel 22 is secured over the panel 26.

When the panels have been folded along their respective crease lines and the panels have been secured by the areas of adhesive, as described above, the container is a box-like form with the top part in a closed condition for transportation.

As will be seen from FIG. 1 the panel 12 includes a break line 42, which slopes downwardly from the rear of the top part to the front of the top part, the panel 13 includes a break line 43 which extends across panel 13, the panel 14 includes a break line 44 which extends from a low position with the break line 43 to a higher position where it crosses the folding line 30, from folding line 30 the line 45 extends across the panel 15, to form the hinge, and the line 46 extends across the panel 16 as a break line.

With this construction the container can be opened by breaching the panel 12 along the line 42, the panel 13 along the line 43, the panel 14 along the line 44 and the panel 16 along the line 46.

With the container so breached the top part is connected to the bottom part only along the hinged line 45, and the top part can be displaced from the closure condition by simply rotating it about the hinge formed along the line 45, and when fully opened the contents of the container are fully exposed.

The improvement made in the present invention is along the break line 43 and wherein approximately one third of the distance in from each of the crease lines 28 and 29 the break line 43 is straight and aligned but between said straight and aligned break lines the line 43 dips downwardly to include a lug 43*a*, which depends downwardly relative to the container and has an arcuate form.

When the line 43 is formed by perforations or a heavily scored line to facilitate breaching of the container, the unperforated or stronger narrow parts of the panel 13, indicated by numeral 13*a*, assist in holding the container closed prior to breaching of the container. In a preferred form of the present invention, said relatively unweakened or unperforated strips of material 13*a* are spaced from the junction of the arcuate downwardly depending lug 43*a* with the straight break lines 43 on either side thereof. The panel 12 may also include an unweakened or unperforated strip 12*a* to assist in strengthening the unbreached container.

When the container has been breached, the top part is allowed to rotate relative to the bottom part along the hinged line 45. In the breached condition the free upper edge 47 of the liner panel 17 is located above the lowermost regions of the arcuate recess in the front panel 13 of the bottom part, which arcuate recess is formed by the lug 43*a* breaking away from the bottom part. When the container is to be closed, the user will simply deflect the central regions of the front panel of the top part to allow the lug 43*a* to pass behind the liner panel 17 and, in this position, the top part is effectively held against opening by the liner panel 17.

It will be readily appreciated by persons skilled in the art that the break line 43 could be reversed, so that the lug 43*a* is formed on the bottom part and is upwardly depending therefrom and in such case the liner 17 may be included in the top part, to be engageable by the lug 43*a* to maintain the container in its closure condition.

It will also be appreciated that other modifications and variations will be apparent to persons skilled in the art.

I claim:

1. A breachable flip-top container having:

a body part including a front panel and a liner panel internal of the front panel, said liner panel having an upper edge; and a top part hingedly connected to the body part and having an edge defined by a break line and having a lug extending from the top part characterized in that when the container is breached, and the top part is in a closed position, the lug is inwardly deflected and engaged over and behind a part of the upper edge of the liner panel.

2. A flip-top container according to claim 1, characterized in that the lug has a width, which is smaller than the width of the container.

3. A breachable flip-top container according to claim 2, characterised in that the lug engageable with the liner panel has an arcuate configuration.

4. A flip-top container according to claim 2 characterized in that the lug has an arcuate configuration.

* * * * *